United States Patent [19]

Campbell

[11] 3,957,237

[45] May 18, 1976

[54] CHOCKS

[76] Inventor: Gaylord K. Campbell, 5113 St. Cyr, Middleton, Wis. 53562

[22] Filed: May 17, 1974

[21] Appl. No.: 470,948

[52] U.S. Cl. ..... 248/1; 24/114.5; 24/129 R; 24/230.5 R; 24/115 M; 24/201 R; 24/206 R; 248/317

[51] Int. Cl.[2] ..... A47G 29/00

[58] Field of Search ..... 248/1, 216, 317, 328; 24/115, 265 EC, 136 K, 135, 196, 171, 114, 129 R, 230.5 R, 201 R, 206 R; 9/46; 294/74, 78 R

[56] References Cited

UNITED STATES PATENTS

| | | | |
|---|---|---|---|
| 1,028,104 | 6/1912 | Fletcher | 24/115 K |
| 1,745,449 | 2/1930 | Poor | 24/136 K |
| 3,002,780 | 10/1961 | Eggeman | 294/78 R |
| 3,148,427 | 9/1964 | Hoffstrom | 24/196 |
| 3,323,185 | 6/1967 | Maras | 24/115 R |
| 3,654,672 | 4/1972 | Bullar | 24/136 K |
| 3,672,006 | 6/1972 | Fidrych | 24/115 N |
| 3,778,072 | 12/1973 | Salomon | 24/196 |
| 3,795,947 | 3/1974 | Thompson | 24/196 |

*Primary Examiner*—Roy D. Frazier
*Assistant Examiner*—Robert A. Hafer
*Attorney, Agent, or Firm*—John M. Winter; Theodore J. Long; Harry C. Engstrom

[57] ABSTRACT

Generally, each of my chock embodiments has one or more of the following features: a rigid body having a nonsuperficial recessed surface portion or portions on one or more of its working surfaces for saddling a rock formation; a cap portion along the top edge of each working surface of the rigid body; a runner aperture opening solely on the bottom surface of the rigid body; a separate anchor wedged in the runner aperture for securing the runner and reinforcing the rigid body; a runner anchor recessed from the top and/or bottom surfaces of the rigid body; a double loop cable runner; and in the smallest sizes, a rigid body having one or more hooked portions for setting over a constriction of a crack in a rock formation and a second portion protruding from the crack for securing a runner.

15 Claims, 40 Drawing Figures

CHOCKS

BACKGROUND OF THE INVENTION

This invention relates to a type of mountaineering hardware often referred to as a "chock", "chockstone", "nut", or by the more generic term "artificial chockstone".

The term "nut" derives from the original artificial chockstones which were, in fact, nothing more than machine nuts which had their internal threads removed or covered over. One or more of these nuts were strung on a loop of rope and gained widespread popularity in the early 1950's through the mid-1960's as mountaineering hardware.

The names "chock" and "artificial chockstone" derive from the still earlier climbing practice of "tying-off" chockstones, a chockstone being a natural rock, block, or stone found jammed or wedged in a crack. To "tie-off" a chockstone is a broad term meaning to tie, in some manner, a rope, sling, cable or webbing around, through, over, behind, or onto a chockstone. The "tied" (a term which includes knots, compression sleeves, and sewn splices) rope, sling, cable or webbing is often referred to as a "tie-off" or a "runner". Basically then, a chock, or an artificial chockstone, is a man-made chockstone-like object tied-off, or suitable for tying-off, with a runner. For simplicity, the artificial chockstones comprising this invention will be referred to hereinafter merely as "chocks".

The basic use of chocks is to secure, through suitable placement, a point of attachment in a crack in a rock formation. The four principal reasons for obtaining such points of attachment are for belaying, anchoring, rappelling and direct aid climbing. These four uses are not totally distinct and under some circumstances overlaps do occur, as for example, when direct aid placements are also relied on for protection in belaying. Nonetheless, the foregoing distinctions constitute readily distinguishable reasons for the chock's usage even if more than one reason might be applicable for a particular chock placement.

The basic modus operandi of chocks in each of the aforementioned uses is the same. The chock is placed in a crack beyond a constriction such that the chock jams, wedges, or otherwise becomes lodged at the constriction when pulled toward the constriction. Of course, in order to achieve this, the crack and the chock must be compatible, that is, the chock must be small enough to fit in the crack, but not so small so as to slip by the constriction while at the same time, the chock's runner must be capable of passing through or around the constriction.

Generally, there are five major considerations in the placement of a chock: (1) the ultimate force the chock may be required to hold; (2) the speed and ease with which the chock may be placed; (3) the position or location of the placement; (4) the direction or directions from which a pull might be exerted on the chock; and (5) the capability of the chock to remain securely placed. The difference in emphasis in these placement considerations can result in an ideal placement of a chock for one of the aforementioned uses to be unacceptable for one or more of the other usages. All five of these placement considerations are affected to some extent by the design of the chock as will become more fully apparent in the discussion presented hereinafter.

In describing a chock, those surfaces which are intended to jam against the supporting rock formation are referred to as "working surfaces". Generally, working surfaces exist as pairs of opposed surfaces. In addition, chocks have top and bottom surfaces. The bottom surface is generally that surface from which the runner typically depends and which faces in the general direction in which the runner is expected to be pulled. It is obvious that with some chock designs capable of being placed in one of several distinct orientations, the surfaces defined as the working surfaces and the bottom surface become a function of the particular orientation under consideration. Nonetheless, with respect to a particular placement, the working surfaces and the bottom surface of the chock are always readily identifiable. The top surface of the chock is that surface which is on proximately the opposite side from the bottom surface. Depending on the particular design, intervening corners may or may not clearly demarcate the varying chock surfaces. In either case, the respective surfaces are functionally distinct when in use.

In practice, the chock is usually placed "on the run" with one hand while hanging on with the other hand, or while precariously balancing on a ledge. Accordingly, it is obvious that, to the extent to which it is practicable, the chock should be uncomplicated, easily placed, and suitable to varying cracks while at the same time it must be both light weight and as strong as is consistent with its size, material, and other design criteria.

A serious problem with all chocks is the persistent tendency of the belay rope to dislodge the chock as the climber continues to climb on above his chock placement. Often the chock is tapped on the top, usually with an alpine hammer, in order to secure a snug setting and thereby minimize this problem. While this practice can be helpful at times, it has the following serious drawbacks: tapping the chock is not consistently successful in preventing the chock's accidental dislodgement; tapping requires that the climber carry a tapping means, usually an alpine hammer; tapping makes removal of the chock difficult; tapping can damage the runner; abrasion caused as a result of tapping is the primary cause of chock degregation; and, in cases where the crack is of insufficient size or of unfavorable geometry, tapping can become awkward or even infeasible. As will become evident, prominent features of my chock invention are directed towards the elimination of these problems.

Typically, most prior art chocks have been either cut from conventional hexagonal bar-stock thus emulating the original "nuts", or cut from other bar-stock usually more or less round in cross section. These chocks have drilled through them, in a direction generally perpendicular to the length of the bar-stock, two apertures through which the runner is passed. Thus the runner is passed from the bottom surface up through the first aperture over the top surface and then back down through the second aperture to the bottom surface where the ends are joined thereby forming a loop. As a result of passing over the top surface of the chock, in those cases where the chock is tapped as is a common practice, interference from the runner renders the tapping ineffective and in addition the runner is always in jeopardy of being damaged. Additionally as a result of the runner egressing through two distinct and separate apertures at the bottom surface, placements requiring that the two depending portions of the runner be in contact at their egress from the chock, so as to permit their passage through a narrow constriction, are prevented.

A feature of some prior art chocks has been the addition of lightening apertures which are drilled either transversely or lengthwise through the bar-stock to reduce the weight of the chock. More recently, special bar-stock possessing the lghtening apertures as an integral part has been specifically extruded for the manufacture of chocks. In addition, changes in the shape of the two tie-off apertures have been tried in an effort to better accommodate the flat webbing currently in use as runners. Nonetheless, all of these chocks are in essence the same as those described heretofore and suffer the same inherent deficiencies.

Another common prior art chock is one fashioned in the general form of a truncated four-sided pyramid where the smaller, truncated end forms the bottom and the two pairs of opposed trapezoidal faces form the working surfaces. As with the aforementioned bar-stock chocks, two apertures connecting the bottom and the top surfaces are provided through which the runner passes up, over the top surface, and back down through the bottom. As is obvious, such a chock and runner system possess those same deficiencies as heretofore described with respect to the runner system in the bar-stock chocks.

Some prior art chocks have a tie-off aperture running from end to end (in bar-stock type chocks) or from side to side (in the truncated pyramid type chocks). These tie-off apertures are essentially the same as the apertures through the original "nuts", however, some have been modified by the addition of slots extending from the ends of the apertures down to the bottom surface. This modification permits the chock to be wedged against the faces in which the apertures are located without pinching the runner. However, in order for this to be accomplished, both ends of the runner have to be successfully held in their slots during the placement of the chock. The problem associated with keeping the runner in its proper place during placement is a major drawback of this design. Some of these chocks having the general form of a truncated pyramid have been further modified by having their top and bottom surfaces oriented so that they form a third taper. In practice, chocks of this particular design have been found to be too complicated to be practicable except in the case of very large sizes.

In order to achieve stronger runners, some chocks, especially in the smaller sizes, have been provided with wire cable runners. Typically, prior art chocks designed for cable runners have two apertures drilled from the top surface down to the bottom surface through which the cable passes up, over the top and back down where the two depending ends are swagged together to form a loop. In this design, the sharp bend which the cable makes as it leaves the top of the apertures critically weakens the cable and the lack of specific provision providing a smoothly arched path in the chock over which the cable can pass is a serious drawback of all prior art chocks having cable runners. In addition, all prior art chocks using cable runners have a single thickness of cable forming the lower loop into which the connecting carabiner is snapped. As a result of the sharp bend in the cable caused by the connecting carabiner, this lower loop of the cable is an additional weak point in this design. Another problem with prior art chocks having cable runners is that when using a rope or webbing runner extension an additional carabiner is required to safely interface the extension to the thin cable runner.

An alternate cable runner design has a single cable depending from the chock and looped back upon itself at the lower end. The single end of the cable passes through an aperture in the bottom of the chock and is retained therein by means of a swagged-on sleeve which is too large to pass back through the aperture. This design typically results in a runner having approximately one-half the strength of the looped cable design described above.

As the size of the crack in a rock formation decreases so does the chock and also the space available for the runner. No prior art chock has provided a runner design for those cases where the crack size is too small to accommodate a cable runner. In the past, pitons rather than chocks have been required for such placements.

Several unique chock designs exist. Two of these designs result from cutting wedge-shaped sections off the end of "I-bar" and "T-bar" extrusions which are subsequently provided with tie-off apertures. These makeshift designs are only suitable to large size chocks. Another design is merely a short cable section with a loop in one end and a compression sleeve forming the chock on the other end. None of these shapes have proved to be particularly suitable for mountain climbing.

A major problem in the design of all prior art chocks is the lack of a specific means for preventing the accidential dislodgement of the chock. Another deficiency in all prior art chocks is the absence of specific provisions for supporting the uppermost edges of the working surfaces of the chock against deformation and/or shear failure. Specific provisions alleviating these two problems as well as other problems described heretofore are prominent features of my clock invention.

SUMMARY OF THE INVENTION

An important feature of my chock invention is the provision of a non-superficial recessed surface portion or portions, said portions having generally upright orientated centerlines, on one or more of the working surfaces of the chock for saddling a rock formation. In the larger size chocks, these recessed surface portions may preferably, but not necessarily, have the concave configuration of the intersection of a cylinder, or a section of a cone, with the working surface in which the recess is formed. Such cylindrical concavity is illustrated in FIG. 9. In the smaller size chocks, the recessed surface portions may preferably, but not necessarily, have the concave configuration generated by the intersection of an ellipsoid with the working surface in which the recess is formed as shown in FIG. 10. This recessed surface portion feature permits my chocks to be safely placed in locations where prior art chocks could not safely be used. In addition, this feature usually permits my chocks to be placed so as to resist unintentional displacement during use which is a significant problem with all prior art chocks. Furthermore, this feature often permits placement of my chocks so as to hold either a downward and/or sideward pull. In sum, the provision of a non-superficial recessed surface portion of portions on one or more of the working surfaces of my chocks results in them being more useful and more versatile chocks.

A second feature of my chock invention is the provision of a cap section most preferably along the top edge of each working surface which reinforces the uppermost portion of each working surface. Prior art chocks which lack this cap section cannot safely be used on the uppermost unsupported portions of their tapers. Since it is often difficult to ascertain the exact point at which the rock formation contacts the chock, this being particularly true of my chocks with their recessed surface portions, this cap feature which supports the upper edge of the chock's working surfaces is a very important safety feature. In addition, by being able to more fully use the top portion of each working surface, the size range of cracks for which the chock is suitable is also increased.

There is a great variation in the width of cracks encountered in climbing and, therefore, chocks must be made in many different sizes. As the size of the chock decreases, space limitations require changes in the specifics of the runner system used. It is therefore clear that while the basic principles of my chock invention remain the same throughout, certain specifics of my invention with regard to the runner system must change. These specifics of the runner system in my chock invention are described below.

In those chocks having rope or webbing runners, provision is made in my chock invention for the protection of the runner against accidental damage when the chock is tapped on the top surface. This is accomplished by providing a runner aperture within the chock wherein the anchoring means over which the runner passes is recessed from the top surface of the chock more than the thickness of the runner. In addition, said aperture is constricted above the anchoring means thereby further shielding the runner. As an additional feature, the anchoring means is sufficiently recessed above the bottom surface so as to permit the depending runner portions to be in engagement on egressing from the bottom of the chock. This feature minimizes the crack width required for the passage of the runner.

As the chocks become progressively smaller, it is evident that the walls surrounding the runner aperture must also become thinner. Eventually these walls become too thin to support the compressive forces to which they can reasonably be expected to be subjected. In my chock invention, specific provision is made for reinforcing these thin walls by the inclusion of a runner anchoring means which wedges in the runner aperture and thereby backs up one or more of the chock walls providing the working surfaces. In addition, the wedging action of the anchoring means can be used to grip the runner and thus reduce the stress in the runner at that critical point where the runner bends over the top of the anchoring means.

Still smaller chocks require, as a result of the severe space limitations, the use of wire cable runners. In my chock invention the cable runner is provided a smoothly arched path through the chock thereby eliminating sharp weakening bends from this portion of the cable. My chock invention also provides a double cable at that critical lower bend into which a carabiner is attached by the climber. This is accomplished by lapping the two depending ends of the cable runner and joining them with two compression sleeves, where said compression sleeves are sufficiently spaced so as to allow the bend in the lower end of the runner to fall between said sleeve in the double, lapped portion of the cable runner. In addition, my chock invention provides a metal tube around the cable at the lower loop portion, this tube being of sufficient diameter to permit a rope or webbing extension runner to be safely connected directly thereto without need of an interfacing carabiner. In an alternate version especially applicable to chocks having longer runners, the cable has a metal ring strung thereon, the diameter of the material forming the ring again being sufficiently large so as to permit a rope or webbing extension runner to be safely attached directly thereto without need of an interfacing carabiner.

Eventually, the chock body and the cracks in which they are used become too small to accommodate any suitable runner within the crack. In these cases my chock invention provides a means whereby a suitable runner may be attached to a portion of the chock outside of the crack and is therefore not restricted in cross section to the width of the crack. This is accomplished in my chock invention by cantilevering the chock head portion to the side of a rigid supporting member where the supporting member has a point of attachment in its lower end into which the runner is subsequently attached. In addition, my invention includes an embodiment of this chock in which two such chocks are formed end to end or back to back. This embodiment permits the chock to be placed into either a right-handed or left-handed corner without interference from the offset portion of the rigid supporting member wherein the runner is attached by merely turning the chock so as to use one or the other of the two symmetrically inversed chock portions.

The foregoing summary of several of the features of my chock invention is not intended to be all inclusive and further objects, features, and advantages of my chock invention will be apparent to those skilled in the art from the following detailed description taken in conjunction with the accompanying drawings showing several embodiments of my chock invention for exemplification.

FIG. *5a* is an isometric view illustrating both the head portion and the depending cable runner portion of a chock embodying the principles of my invention.

FIG. *5b* is an isometric view illustrating two alternate variations of the cable runner portion of the chock embodiment illustrated in FIG. *5a*.

Figure 6:
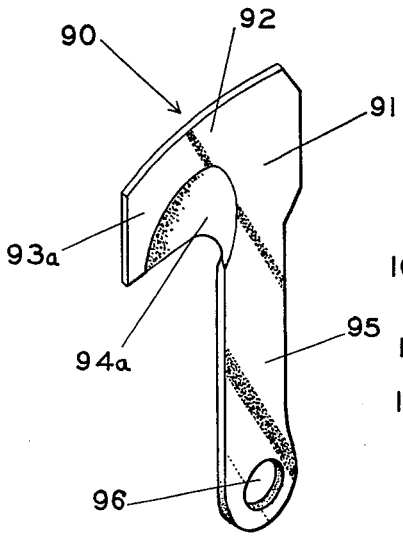
Figure 7:
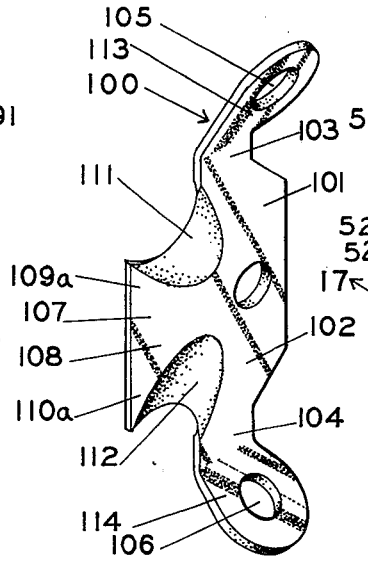
Figure 8:
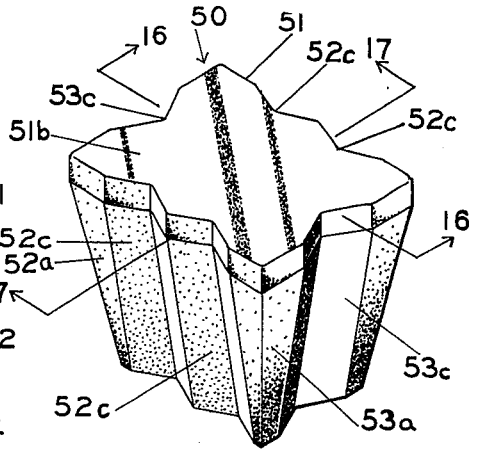

FIG. 6–8 are isometric views of three more chocks embodying the principles of my invention.

Figure 9:
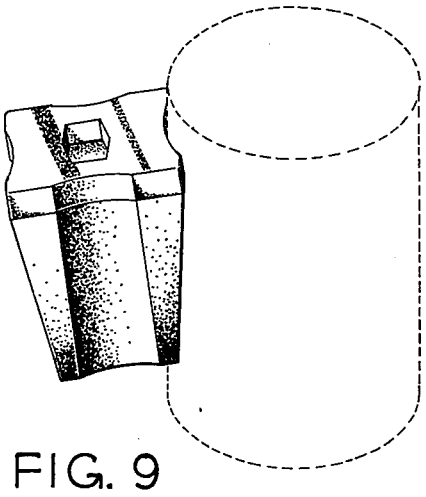

FIG. 9 is an isometric view of a chock illustrating that a recessed surface portion in a working surface of a chock may take the configuration of the intersection of a cylinder (shown in broken lines) with the working surface in which the recess is formed.

Figure 10:
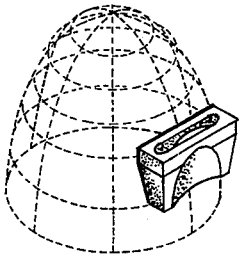

FIG. 10 is an isometric view of a chock of the type designed to have a wire cable runner illustrating that a recessed surface portion in a working surface of a chock may take the configuration of the intersection of an ellipsoid (shown in broken lines) and the working surface in which the recess is formed.

Figure 4:
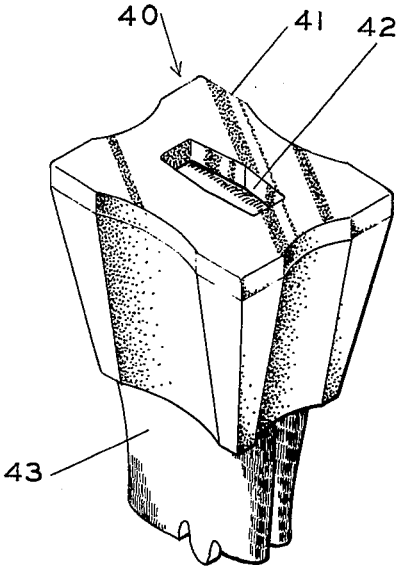
FIGS. 1–4 are isometric views of chocks embodying the principles of my invention.
Figure 11:
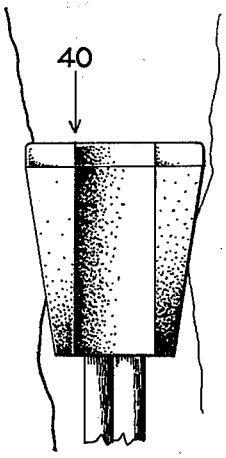

FIG. 11 is a side elevation view showing the placement of the chock of FIG. 4 in an opening in a rock formation.

Figure 12:
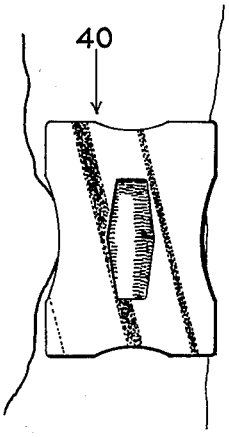

FIG. 12 is a top view showing the placement of the chock of FIG. 11 saddling the projection of a rock formation.

Figure 13:
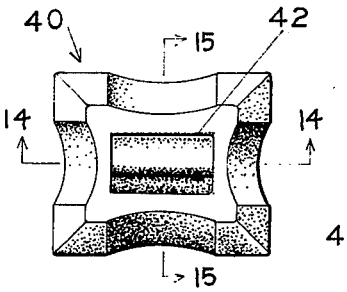

FIG. 13 is a bottom view of the chock of FIG. 4 without a runner.

Figure 14:
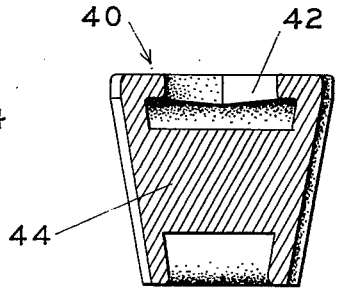

FIG. 14 is a section view of the chock of FIG. 13 taken along line 14—14.

Figure 15:
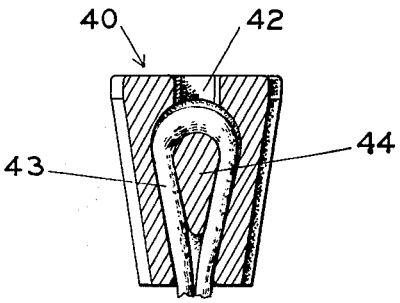

FIG. 15 is a section view of the chockstone of FIG. 13 taken along line 15—15 with a runner shown.

Figure 16:
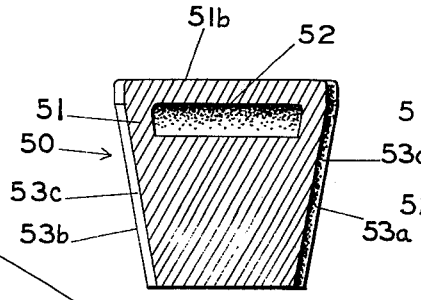

FIG. 16 is a section view of the chock of FIG. 8 taken along line 16—16.

Figure 17:
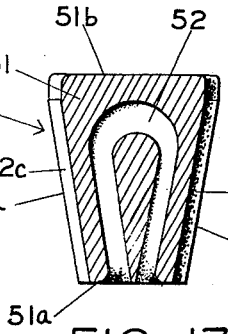

FIG. 17 is a section view of the chock of FIG. 8 taken along line 17—17.

Figure 3:
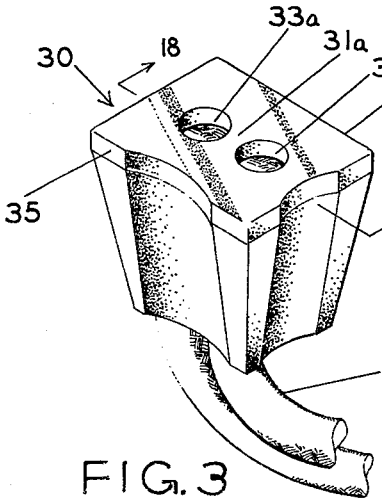
Figure 18:
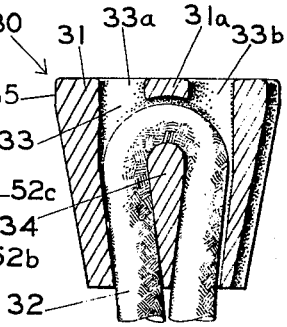

FIG. 18 is a section view of the chock of FIG. 3 taken along line 18—18 with a runner shown.

Figure 2:
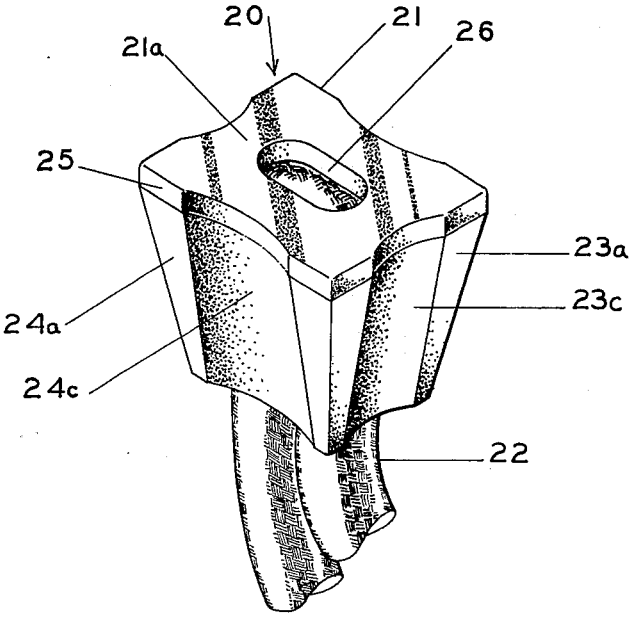
Figure 19:
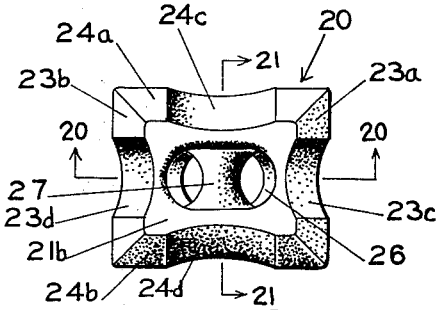

FIG. 19 is a bottom view of the chock in FIG. 2 without a runner.

Figure 20:
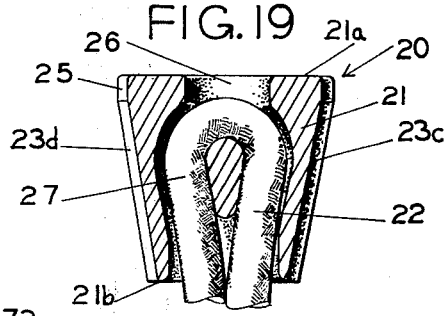

FIG. 20 is a section view of the chock of FIG. 19 taken along line 20—20 with a runner shown.

Figure 21:
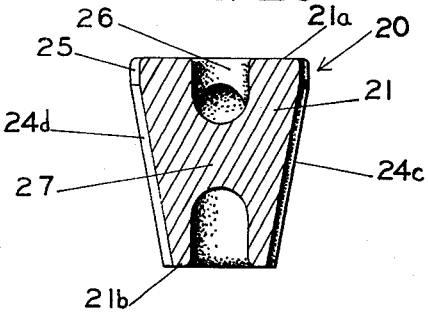

FIG. 21 is a section view of the chock of FIG. 19 taken along line 21—21.

Figure 22:
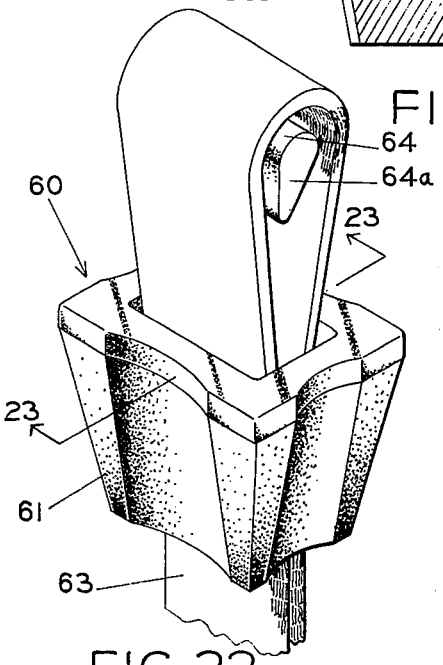

FIG. 22 is an isometric view of another chock embodying the principles of my invention with a removable type anchor and webbing type runner being placed therein.

Figure 23:
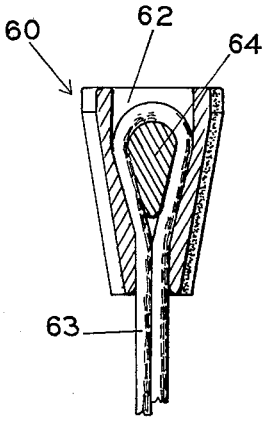

FIG. 23 is a vertical section view of the chock shown in FIG. 22 taken along line 23—23 with the anchor and runner in place.

Figure 24:
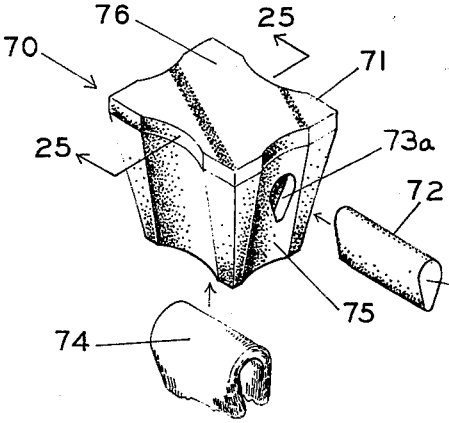

FIG. 24 is an isometric view of another chock embodying the principles of my invention with a removable type anchor and webbing type runner being placed therein.

Figure 25:
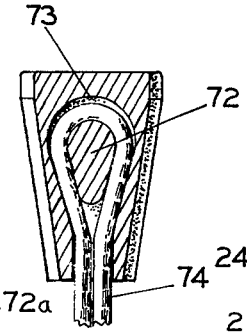

FIG. 25 is a vertical section view of the chock shown in FIG. 24 taken along line 25—25 with the anchor and runner in place.

Figure 26:
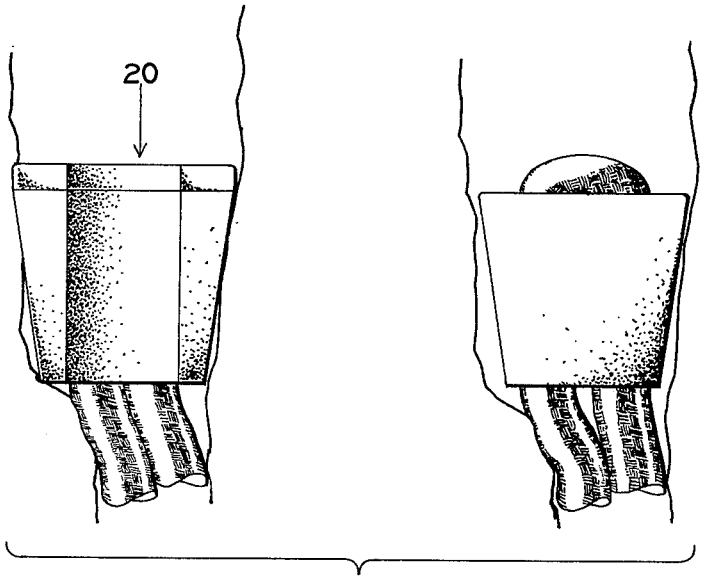

FIG. 26 is a side elevation view showing the placements of one embodiment of my chock and a prior art chock in an identical opening in a rock formation.

Figure 27:
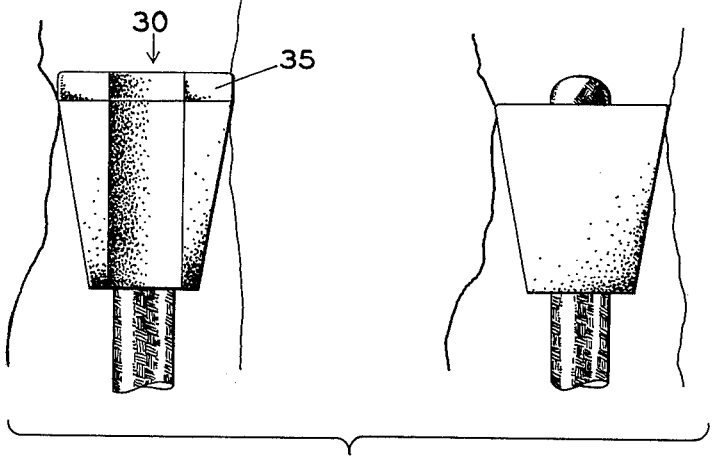

FIG. 27 is a side elevation view showing the placements of one embodiment of my chock and a prior art chock in an identical opening in a rock formation.

Figure 1:
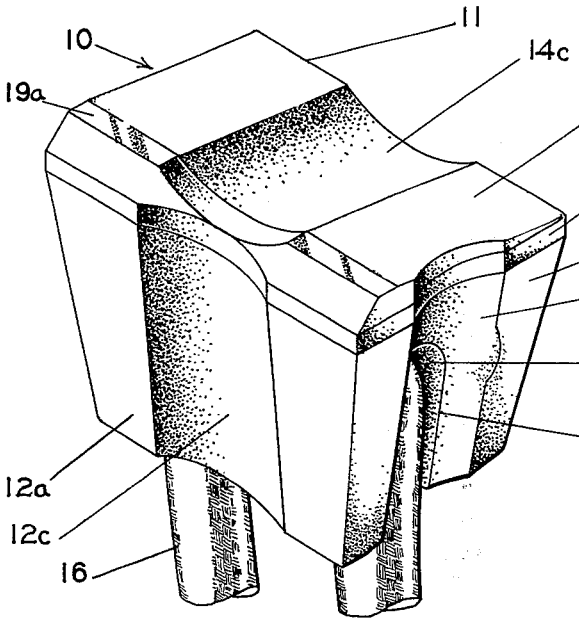

FIGS. 28–32 are side elevation views of the chock of FIG. 1.

Figure 33:
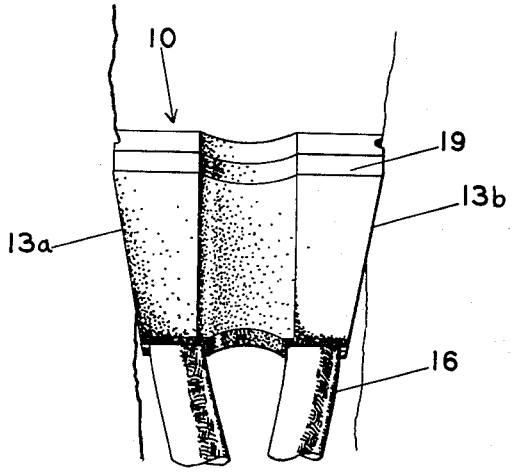
Figure 35:
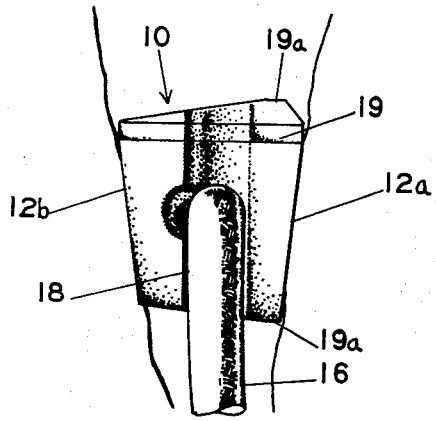
Figure 34:
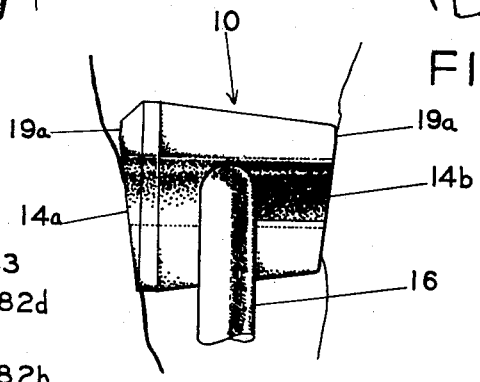

FIGS. 33–35 are side elevation views of the chock of FIG. 1 in three different orientations in cracks of three different widths in a rock formation.

Figure 36:
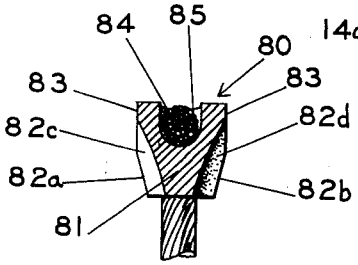

FIG. 36 is a section view of the chock of FIG. 5 taken along line 36—36.

Figure 37:
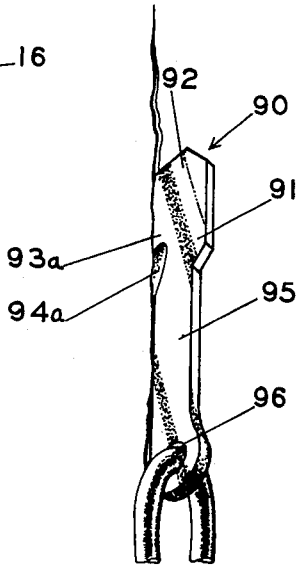

FIG. 37 is an isometric view showing the placement of the chock of FIG. 6 in a crack in a rock formation.

Figure 38:
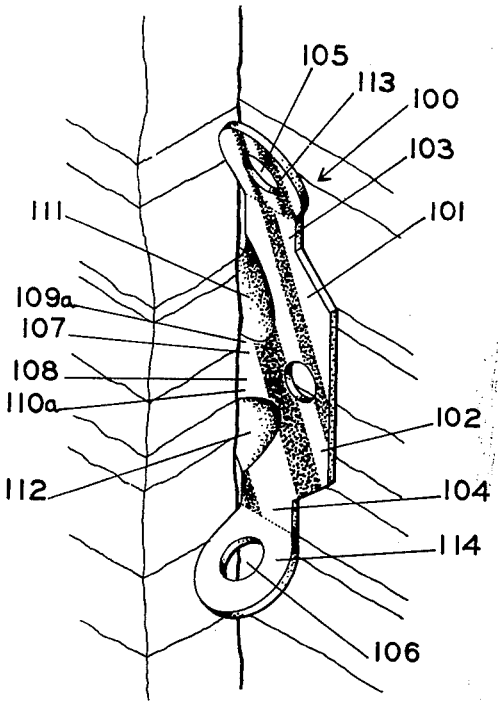

FIG. 38 is an isometric view showing the placement of the chock of FIG. 7 in a crack in a rock formation.

Figure 39:
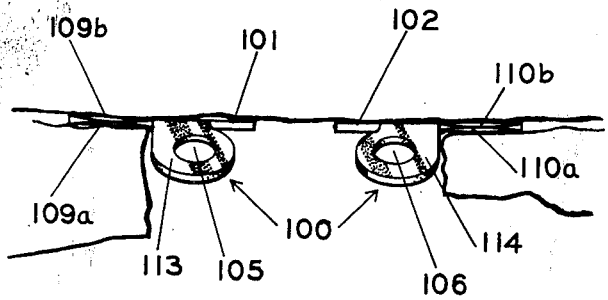

FIG. 39 is a top view of the placements of chocks of the type shown in FIG. 7 in right and left inside corner cracks of a rock formation.

DESCRIPTION OF PREFERRED EMBODIMENTS

Differences in the size of cracks in which chocks are used necessitates chocks of varying sizes. While the basic principles of my chock invention remain the same for all sizes, specific differences in design are necessitated as a result of the varying space limitations. It should be evident that certain embodiments may be more applicable to one size of chock than another; however, it should not be construed that any specific embodiment or feature thereof is limited solely to that preferred size described herein. while recognizing that extensive size overlaps do exist, I will nonetheless attempt to discuss the various embodiments in their general order of declining size.

FIGS. 1–8, 22 and 24 show ten embodiments of my chock invention each having at least one working surface with a non-superficial recessed surface portion formed therein for saddling a rock formation. The recessed surface portions can be used in all sizes of my chocks as shown and this feature is the basis from which all of the embodiments shown have evolved. While in the drawings each pair of opposed working surfaces of each chock is depicted with one or more recessed surface portions formed therein, this feature of my invention may be employed with as few as a single recessed surface portion in a chock regardless of the number of working surfaces on the chock.

The basis of the great utility of my chocks with the non-superficial recessed surface portion feature is their ability to saddle a single constricting point of a crack in a rock formation. This feature allows a climber to hood or set the chock over a single constricting point and once set the chock cannot be moved sideways without first being lifted up. This advantage can be applied to the case of the typical crack having more or less parallel walls by purposefully saddling a recessed surface portion of the chock over a nubbin or otner wall projection, as best illustrated in FIGS. 11 and 12, thus locking it against lateral displacement. This important feature stems from the fact that the generally upright recessed surface portions of the working surfaces of the chock make the cross section at the center of the chock thinner than at the edges. Thus, in an irregular crack, the chock can slip down further when the constriction is at the center than it can with the constriction at the edge. Once the center is slipped down so as to saddle the constriction, the chock has passed the point where the edges could have fit the constriction; consequently, only by lifting the chock can it be made to move laterally. Since preventing a chock from slipping out of a crack sideways is of pivotal importance in the use of chocks as discussed hereinbefore, this feature is an important improvement in the chock art.

The importance of the recessed surface portion design can be appreciated by noting that when saddling a constriction, a chock with this feature is tapered in three directions with respect to the constriction. In other words, once saddling a constriction, the compound taper of the chock at the point of contact with the constriction prevents its further movement downward or to either side. For this reason, the chock, when properly saddling a constriction, is equally suited for holding downward and horizontal loads, a feature of immense practicality.

A second feature which is embodied in my chocks is the provision of a raised cap portion. While I will refer to this cap portion as being a vertical or straight section, in fact, in most embodiments, it is tapered slightly in a direction opposite to that of the lower taper and usually has a somewhat rounded upper edge. The safety feature of the cap portion is best illustrated in FIG. 27. For example, it is sometimes necessary, when the crack in the rock formation is around a corner or off to one side, to place a chock by feel alone. When a crack is too narrow or too deep for the climber to insert his hand, he must merely jiggle and yank on the runner until the chock seems to hold. In the case of prior art chocks there is always the possibility that the chock might jam on or near the very thin top edge as shown on the right side in FIG. 27. In this event, the chock would feel secure while in reality being incapable of holding a serious fall since under the extreme forces developed in a fall, this thin upper edge would merely deform or shear-off. However, as illustrated on the left side of FIG. 27, in my design the widest point of the chock at the top edge of the working surfaces is backed up by the mass of the raised cap portion. In the case of a shear failure, the shear would have to extend through the entire thickness of the raised cap portion. This cap feature therefore greatly minimizes the chances of setting a chock in a placement which feels secure while in reality it is unsafe.

A second aspect of the raised cap portion is that it increases the number of situations in which the particular chock can be used. By truncating that portion of the chock on which the chock cannot be safely placed anyway, I lose nothing but gain the advantage in that the chock can now slip into a narrower crack than if the lower taper extended all the way to the top of the chock as in the prior art. This is particularly important in the case of the smaller size chocks where, for reasons of strength, the climber always should attempt to use the largest chock which will fit into a particular crack. This cap feature thus makes my chocks, in terms of the range of crack sizes for which they are suitable, much more versatile.

Figure 28:
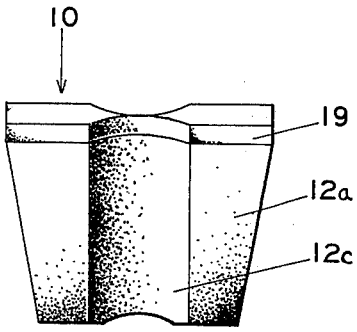
Figure 29:
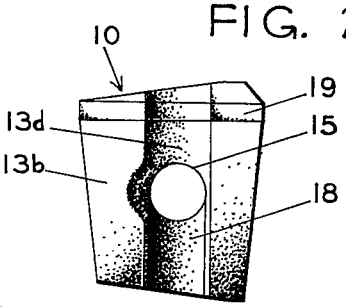
Figure 30:
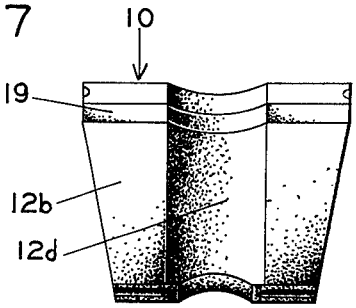
Figure 31:
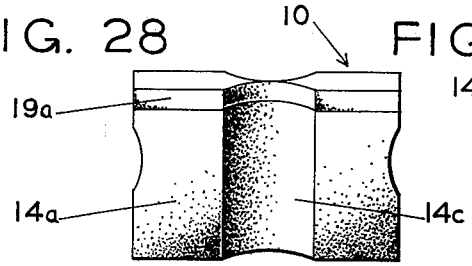
Figure 32:
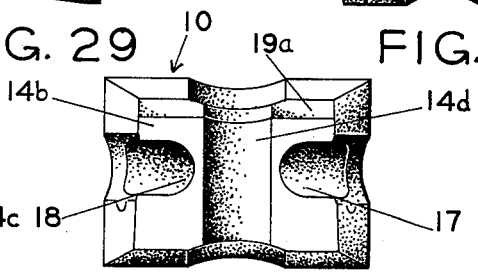

Referring now more particularly to the various embodiments shown in the drawings, the large chock 10 illustrated in FIGS 1 and 28–35 exemplifies and incorporates both of these recessed surface portion and cap features Chock 10 comprises a rigid body 11 having three pairs of opposed working surfaces 12*a* and *b*, 13*a* and *b* and 14*a* and *b*. The working surfaces have non-superficial recessed surface portions, respectively, 12*c* and *d*, 13*c* and *d* and, 14*c* and *d*, formed therein. The working surfaces in this embodiment are selected so as to provide three over-lapping tapers yielding a continuum of sizes from the base of the smallest to the top of the largest. The rigid body of chock 10 is designed such that the working surfaces 12*a* and *b*, comprising an opposed pair, are generally trapezoidal as illustrated in FIGS. 28 and 30. The working surfaces 13*a* and *b*, which are mirror images of one another and form another opposed pair, have the general configuration of a trapezium. The opposed working surfaces 14*a* and *b* of the third pair are generally rectangular as shown in FIGS. 31 and 32.

The rigid body of chock 10 has an aperture 15 extending therethrough between working surfaces 13*a* and *b* for receiving a rope type runner 16. As best shown in the drawings, the working surfaces 13*a* and *b* have grooves 17 and 18, respectively, formed therein connecting with aperture 15 for receiving the rope runner. These grooves are at least as deep as the thickness of the rope runner so as not to interfere with the employment of recessed surface portions 13*c* and *d* when the chock is placed in the widest crack for which it is designed as shown in FIG. 33. Second and third placements of chock 10, in progressively narrower cracks, as shown in FIGS. 34 and 35. Chock 10 incorporates above discussed cap feature as shown by cap portions 19 and 19a in the drawings.

The next general size category is illustrated by chocks in FIGS. 2, 3, 4 and 8. These chocks 20, 30, 40 and 50 are characterized by two pairs of opposed working surfaces forming two distinct tapers of different widths. Each of the pairs of opposed working surfaces has one or more non-superficial recessed surface portions shown therein and each chock has the above discussed cap feature. Furthermore, each of the chocks shown in FIGS. 2, 3, 4 and 8 incorporate at least one additional feature for exemplification which may be employed in any of these chocks.

Referring to FIGS. 2 and 19–21, the chock 20 shown therein comprises a rigid body 21 designed to be used in conjunction with a rope runner 22. The chock has two pairs of opposed working surfaces 23*a* and *b* and 24*a* and *b* forming two distinct tapers of different widths. The working surfaces have non-superficial recessed surface portions 23*c* and *d* and 24*c* and *d* formed therein. The chock has a cap portion 25 along the top edge of the working surfaces. An aperture 26 for receiving a rope runner 22 extends from the top surface 21*a* to the bottom surface 21*b*. As shown in FIGS. 19–21, an anchor 27 formed integral with the chock body extends across the aperture and the rope runner is looped around the anchor. The anchor is recessed below the top surface more than the thickness of the runner so that when the runner is in contact with the anchor, it is recessed below the top surface as shown in FIGS. 2 and 20. In addition, the runner aperture is constricted above the anchor thereby shielding and providing additional protection for the runner from tapping. Furthermore, the anchor is also recessed from the bottom surface of the chock so that the two depending portions of the runner can engage each other on egressing from the chock thereby minimizing the crack size required for their passage. The usefulness of this feature is illustrated in FIG. 26 which, on the right, shows a prior art chock wherein the depending portions of the rope runner as spaced from one another at their egress from the bottom of the chock and interfere with the placement of the chock. The solid placement of my chock 20 in the same crack without runner interference is shown on the left in FIG. 26.

FIGS. 3 and 18 show a chock 30 having a rigid body 31 similar to the body of chock 20, but with only one recessed surface portion per pair of opposed working surfaces and a somewhat different aperture configuration for a runner 32. As shown in FIG. 18, the aperture 33 is generally H-shaped in section, the rope runner 32 being looped through the smoothly arched cross-portion of the H. This particular embodiment provides two openings 33*a* and 33*b* in the top surface of the chock through which a prod may be inserted to assist in inserting the runner. The bridge portion 31*a* between the openings in the top surface provides additional strength across the narrower width of the chock as well as a surface on which the chock can be tapped without danger of damaging the runner recessed therebelow. For an illustration of an anchor feature somewhat different than that shown in chock 20, the anchor 34 in chock 30 extends to the bottom of the rigid body 31. In all other respects, this embodiment of my chock invention, is substantially identical in design to chock 20 just described. The usefulness of the cap feature discussed hereinbefore is illustrated on the left in FIG. 27 showing chock 30 with a cap portion 35 and on the right a prior art chock without such a cap feature.

In order to realize the inherent advantages of flat webbing runners which are capable of being passed through narrower cracks than rope runners, chock 40 shown in FIGS. 4 and 13–15 comprises a rigid body 41 having an aperture 42 specifically designed to complement a flat webbing runner 43. In general, the aperture passes through the rigid body in somewhat the same manner as the aperture 26 in chock 20; however, instead of a rounded passageway, the aperture configuration is generally that of a thin slot whose dimensions are approximately those of the webbing runner. Thus, the flat webbing runner is allowed to lie in a substantially flat manner as it passes around the anchor 44 and as it engresses from the bottom of the chock. In all other respects, this embodiment of my chock invention, is substantially identical in design to chock 20. The usefulness of the recessed surface portion feature discussed hereinbefore is illustrated in FIGS. 11 and 12 showing the recessed surface portions of chock 40 saddling a rock formation to prevent lateral displacement of the chock.

chock 50 shown in FIGS. 8, 16 and 17 comprises a rigid body 51 with an aperture 52 substantially in the form of an inverted "U" opening solely on the bottom surface 51*a* of the body thus permitting a completely closed top surface 51*b* which provides the ultimate protection for a runner. For exemplification chock 50 is shown with two laterally spaced V-shaped recessed surface portions 52*c* in each of opposed working surfaces 52*a* and 52*b* and a single V-shaped recessed surface portion 53*c* in each of the opposed working surfaces 53*a* and 53*b*. This is illustrative of the fact that the generally upright non-superficial recessed surface portions in the working surfaces of my chocks may take a variety of shapes and that a particular working surface may have more than one such recessed surface portion formed therein.

Chock 60 as shown in FIGS. 22 and 23 differs from my previously described chocks in the manner in which the runner is secured. As the size of the chock decreases, so does the space available for the walls of the chock body, the runner aperture, and the runner anchor. Initially, the walls of the chock body can be made thinner without affecting the design, however, eventually a point is reached where the minimum dimension in which the runner aperture can be cast without leaving the walls of the chock body unduly thinned is reached. In a chock such as 60, additional support for the walls of the chock body is desired because the walls are thinnest in the recessed surface portions in the center of the working surfaces where the stress is the greatest when the chock is placed in use. Reinforcement of these relatively thin walls is accomplished by providing a wedge-type runner anchor which gives internal support to the chock body as it jams or wedges downwardly between the interior wall surfaces of the chock body. As shown in the drawings, the rigid body 61 of the chock has a tapered runner aperture 62 extending from top to bottom. A webbing runner 63 is looped over a wedge shaped anchor 64 and drawn down into the runner aperture thereby engaging against the interior surface of the rigid body. This wedging action not only reinforces the walls of the chock body on which the recessed surface portions are formed but it also pinches the runner against the walls. As tension is exerted on the runner, the anchor over which the runner passes tends to jam downwardly further into the tapered aperture producing a pinching action on the runner thereby reducing some of the tension which would otherwise be developed at the bend in the runner over the top of the anchor. The ends 64*a* of the anchor may be tapered to provide wedging action and reinforcement for the opposite working surfaces.

As illustrated in FIGS. 24 and 25, a chock such as 70 having a chock body 71 with a closed top 76 providing maximum rigidity may be provided with a wedge-type anchor 72 which is placed into a tapered runner aperture 73 via a slide opening 73a extending through the chock body. A looped end of a runner 74 is first inserted upwardly into the runner aperture through the bottom of the chock body and the anchor is then inserted into the loop through opening 73*a*. With the anchor 72 in place, tension on the runner 74 causes a wedging action and reinforcement of the walls as in chock 60.

Figure 5A:
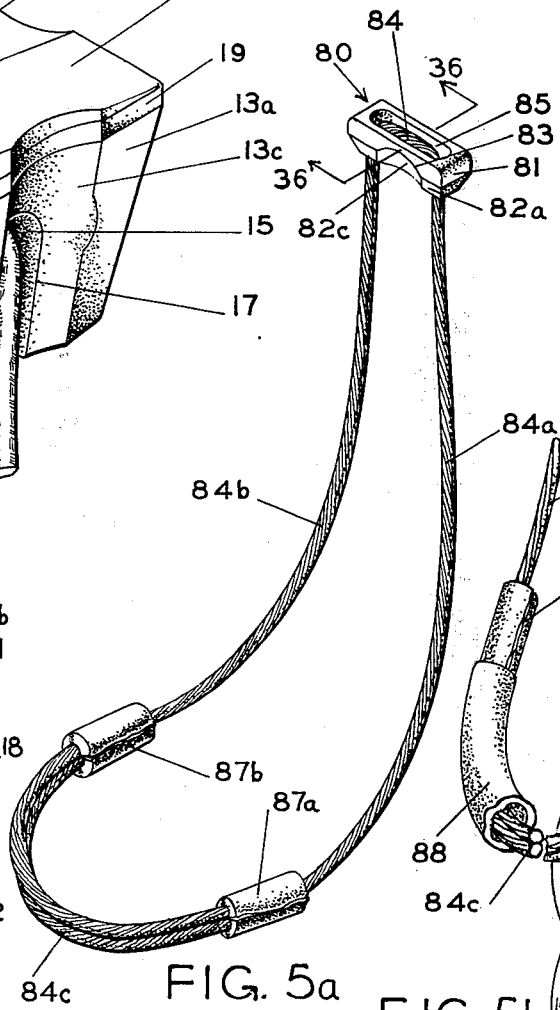
Figure 5B:
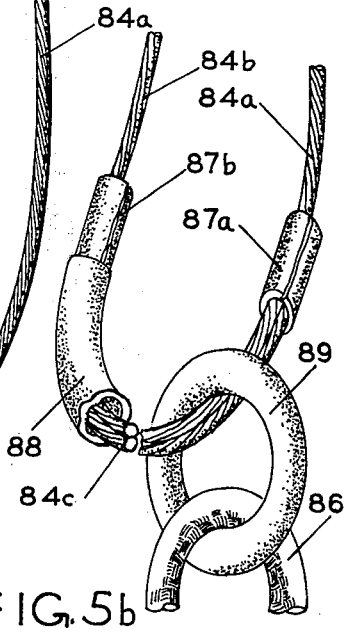

The next general size category of my chocks is depicted by chock 80 in FIGS. 5*a*, 5*b* and 36. As space limitations become still more severe, the use of a wire cable runner becomes necessary. Chock 80 comprises a rigid body 81 having opposed tapered working surfaces 82*a* and *b* having non-superficial recessed surface portions 82*c* and *d*, respectively, formed therein. As illustrated in the drawings, the recessed surface portions in this type of chock preferably take the shape of the intersection of an ellipsoid and the working surface in which the recess is formed. The recessed surface portion may extend into the lower portion of the raised cap 83 as shown. A wire cable runner 84 extends down through a pair of apertures formed in the chock body 81 and a channel, substantially in the shape of an inverted "U" 85, connects the apertures via a smooth arc in the top of the chock body. The remainder of the groove may be filled with an epoxy resin for additional protection of the cable runner. As seen in FIGS. 5*a* and *b* the cable runner has a pair of depending cable portions 84*a* and *b* extending from the bottom of the chock body. The cable portion 84*a* extends downwardly through a first compression sleeve 87*a* and bends around upwardly into a second compression sleeve 87*b*. The other depending cable portion 84*b* extends downwardly through compression sleeve 87*b* and then upwardly into compression sleeve 87*a* to provide a double cable bottom loop 84*c* at the critical lower bend between the compression sleeves wherein a carabiner will be attached when in use by a climber.

Two alternate versions of the lower loop portion 84*c* of chock 80 are illustrated in FIG. 5*b*. These versions are of great advantage in that they permit a rope or webbing extension runner 86 to be safely connected directly to the chock without need of an interfacing carabiner. The left-hand portion shows a metal tube 88 extending around the lower loop portion 84c thereby shielding an interconnecting rope, or webbing, extension runner from the narrow cable. The right-hand portion shows a metal ring 89 strung onto the loop portion 84*c* of the cable runner 84, and an interconnecting rope extension runner 86 looped through the ring illustrating direct attachment to the chock. This latter variation of my chock invention is especially advantageous in cases where the cable runner 84 is long since the ring 89 assures free movement of the interconnecting extension runner 86 up and down the cable runner 84.

The smallest size category of my chocks wherein the chock body and crack in which the chock body is to be placed are too small to accommodate any suitable runner is exemplified by chock 90 in FIGS. 6 and 37 and chock 100 in FIGS. 7, 38 and 39.

Chock 90 comprises a rigid body 91 having a head portion 92 cantilevered laterally to the side of a depending supporting member 95. A pair of mirror image opposed working surfaces, one of which is shown at 93*a*, are formed on either side of the head portion 92 each having a non-superficial recessed surface portion, one of which is shown at 94*a*, formed therein. As with the other embodiments of my chock, there may be one such non-superficial recessed surface portion in a single working surface, or one such non-superficial recessed surface portion in each working surface, or several laterally spaced non-superficial recessed surface portions in each of one or more working surfaces. An aperture 96 providing means of attachment to the chock is formed in the lower end of the supporting member 95.

Chock 100 shown in FIGS. 7, 38, and 39 comprises two integrally formed chocks 101 and 102 of the type described immediately hereinbefore, chock 90, joined head to head along their top edges. As such, chock 100 has two alternative supporting members 103 and 104, two alternative apertures for connecting to the chock 105 and 106, and two alternative head portions 107 and 108. Each head portion provides a pair of opposed working surfaces 109*a* and *b*, and 110*a* and *b*, wherein the non-superficial recessed surface portions are formed. One such non-superficial recessed surface portion 111 and 112 being shown for exemplification in each working surface. Additionally, a portion of each supporting member 113 and 114 containing the aperture has been bent out of the plane of the head portions 101 and 102 so as to permit clearance for a runner. The design of chock 100 enables it to be placed into either a right facing corner as shown in FIG. 8 and on the left in FIG. 39 or in a left facing corner as shown on the right in FIG. 39 merely by turning the chock so as to use one or the other of the two symmetrically inversed portions thereof.

It should be understood that my invention is not confined to the particular construction and arrangement of parts herein illustrated and described in the several embodiments shown for exemplification, but embraces all such modified forms thereof as come within the scope of the following claims.

I claim:

1. A mountaineering chock comprising: a rigid body having an aperture for accommodating a runner, a bottom surface, said runner aperture opening on said bottom surface, at least one pair of opposed external working surfaces tapering towards said bottom surface for engaging a rock formation, and at least one non-superficial concave surface portion formed in the lateral midsection of at least one of said opposed working surfaces for saddling a rock formation, said non-superficial concave surface portion being distinct from said runner aperture, the general centerline of said non-superficial concave surface portion having a substantially upright orientation in the direction of the taper of the working surface in which it is formed whereby said concave surface portion restricts the lateral displacement of the chock from the saddled rock formation.

2. A mountaineering chock as specified in claim 1 wherein said working surfaces are substantially flat, and said concave surface portion extends through to the bottom surface of said body.

3. A mountaineering chock as specified in claim 1 having two or more pairs of said opposed downwardly converging external working surfaces, at least one of said working surfaces in each of said pairs having one or more of said non-superifical concave surface portions formed in the lateral midsections thereof.

4. A mountaineering chock as specified in claim 1 wherein at least one of said working surfaces has at least two of said non-superficial concave surface portions formed in the lateral midsection thereof, said concave surface portions being in the form of laterally spaced elongate grooves.

5. A mountaineering chock as specified in claim 1 wherein at least one of said working surfaces has a non-superficial raised cap portion extending along and substantially vertically upward from the top edge of said working surface for reinforcing the top edge thereof against shear forces.

6. A mountaineering chock as specified in claim 1 wherein said rigid tapered body has a top surface, said aperture for accommodating a runner extending through said body from said top surface, anchoring means recessed from said top surface in said aperture for securing a runner, and a constriction in said aperture above said anchoring means.

7. A mountaineering chock as specified in claim 1 wherein said aperture for accommodating a runner opens solely on said bottom surface, and anchoring means within said aperture for securing a runner in said body.

8. A mountaineering chock as specified in claim 1 wherein said aperture for accommodating a runner is formed substantially in the shape of an inverted "U" and opens solely on said bottom surface.

9. A mountaineering chock as specified in claim 1 having removable anchoring means in said aperture and around which said runner is to be looped, and a constriction in said aperture preventing said anchoring means and said runner looped therearound from being displaced from said aperture through said opening on said bottom surface.

10. A mountaineering chock as specified in claim 9 wherein said anchoring means wedges the runner looped therearound against the constriction in said aperture reinforcing at least one said concave surface portion of one working surface.

11. A mountaineering chock as specified in claim 9 wherein said rigid tapered body has a top surface and said aperture for accommodating a suitable runner has an opening on said top surface through which said removable anchoring means can be inserted into its anchoring position within said aperture.

12. A mountaineering chock as specified in claim 1 wherein said rigid tapered body has a wire cable runner extending through said aperture, said runner having a pair of depending cable portions extending downwardly from said body, one of said depending cable portions extending through a first compression sleeve and turning upwardly into a second compression sleeve, and the other of said depending cable portions extending through said second compression sleeve and turning upwardly into said first compression sleeve thereby forming a double cable bottom loop between said compression sleeves.

13. A mountaineering chock as specified in claim 1 wherein said rigid tapered body has a wire cable runner extending through said aperture and depending therefrom, said runner having a bottom loop portion, and a substantially rigid "U" shaped metal tube having said bottom loop portion extending therethrough.

14. A mountaineering chock as specified in claim 1 wherein said rigid tapered body has a wire cable runner extending through said aperture and depending therefrom, said runner having a bottom loop portion, and a nonopening metal ring strung on said bottom loop portion into which subsequent attachment can be made.

15. A mountaineering chock comprising: a rigid body having a vertical axis and having an aperture for accommodating a runner, a bottom surface, said runner aperture opening on said bottom surface, at least one pair of opposed external working surfaces converging towards said bottom surface and forming a taper on said rigid body toward said vertical axis and at least one of said working surfaces of said pairs of said opposed working surfaces having a non-superficial raised cap portion extending upward and substantially parallel to said vertical axis from the top edge of said working surface for reinforcing the top edge thereof against shear forces.

* * * * *

UNITED STATES PATENT OFFICE

CERTIFICATE OF CORRECTION

Patent No. 3,957,237 Dated May 18, 1976

Inventor(s) Gaylord K. Campbell

It is certified that error appears in the above-identified patent and that said Letters Patent are hereby corrected as shown below:

In Column 3, line 7, "lghtening" should be "lightening".

In Column 8, line 14, "hood" should be "hook".

In Column 10, line 28, "as" should be "are".

In Claim 15, Column 16, line 1, "upward" should be "upwardly".

Signed and Sealed this

Seventh Day of September 1976

[SEAL]

*Attest:*

RUTH C. MASON
*Attesting Officer*

C. MARSHALL DANN
*Commissioner of Patents and Trademarks*